United States Patent [19]

Staubli

[11] Patent Number: 5,058,275

[45] Date of Patent: Oct. 22, 1991

[54] CHISEL

[76] Inventor: Jurg G. Staubli, 12 Chapel Lane, Wilmslow, Cheshire, United Kingdom, SK9 5HX

[21] Appl. No.: 460,159

[22] PCT Filed: Jul. 20, 1988

[86] PCT No.: PCT/GB88/00583

§ 371 Date: Mar. 16, 1990

§ 102(e) Date: Mar. 16, 1990

[87] PCT Pub. No.: WO89/00484

PCT Pub. Date: Jan. 26, 1989

[30] Foreign Application Priority Data

| | | | |
|---|---|---|---|
| Jul. 21, 1987 | [GB] | United Kingdom | 8717200 |
| Aug. 18, 1987 | [GB] | United Kingdom | 8719504 |
| Feb. 17, 1988 | [GB] | United Kingdom | 8803632 |

[51] Int. Cl.[5] ..... B26B 3/00; B26B 3/08; E04F 21/00; E04G 21/20

[52] U.S. Cl. ..... 30/170; 30/168; 15/105.5; 15/235.3

[58] Field of Search ..... 30/169, 170, 171, 500, 30/168; 173/90, 119, 122, 124; 81/489; 29/239; 15/105.5, 235.3

[56] References Cited

U.S. PATENT DOCUMENTS

| | | | |
|---|---|---|---|
| 864,260 | 8/1907 | Rehfeld | 30/170 |
| 3,237,235 | 3/1966 | Moody | 30/170 |
| 3,662,423 | 5/1972 | Miller | 15/235.3 |
| 4,324,042 | 4/1982 | Lipka et al. | 30/170 |

FOREIGN PATENT DOCUMENTS

| | | | |
|---|---|---|---|
| 97791 | 7/1897 | Fed. Rep. of Germany | 30/170 |
| 953182 | 12/1949 | France | 30/170 |
| 1412214 | 10/1975 | United Kingdom | 15/105.5 |

*Primary Examiner*—Douglas D. Watts
*Assistant Examiner*—Paul M. Heyrana Sr.
*Attorney, Agent, or Firm*—Spensley, Horn, Jubas & Lubitz

[57] ABSTRACT

A chisel for removing material (5) from a crack defined between two adjacent bricks, comprising a body (1) supporting an elongate tip (2) and defining shoulders (4) extending transversely of the tip. The width of the tip is less than the width of cracks from which it is desired to remove material and the width of the shoulders is greater than the width of the cracks such that the shoulders limit the depth of insertion of the tip into the cracks. The shoulders may be fixed surfaces, which may be covered with or fabricated from materials which will not mark bricks across which they slide, or alternatively the shoulders may be defined by rollers (22).

12 Claims, 4 Drawing Sheets

CHISEL

The present invention relates to a chisel, and in particular to a chisel for removing material from a crack defined between two adjacent bricks.

Masonary walls are generally built from bricks of regular or irregular shape with the bricks being separated by thin layers of mortar or the like. The primary purpose of the mortar is not to adhere adjacent bricks together but to provide a secure bed for one brick when it is placed upon an immediately adjacent lower brick.

Over time the mortar becomes weakened and can become seriously eroded. If this occurs it is necessary to repair the wall by removing loose mortar from the cracks defined between adjacent bricks and repointing the wall, that is inserting fresh mortar or the like into the cracks.

Traditionally, when a wall has been repointed, loose material is hacked out of the cracks between adjacent bricks using a simple pick the point of which is hammered into the mortar manually. This is a laborious process and accordingly alternative methods have been suggested. The most widely used alternative method is to insert a rapidly rotating abrasive disc into the cracks between adjacent bricks. This is a highly effective method for removing unwanted mortar but presents various problems in that it generates large quantities of dust and can be highly dangerous in that there is a tendency for the disc to act as a driving wheel and pull the disc and its associated power tool across the face of the wall. This can cause physical injury and also can damage the wall surface if the disc runs across the face of bricks making up the wall. Furthermore it is difficult with a disc to clean mortar from a crack of only limited length, such as that defined between the adjacent ends of house bricks of conventional size.

It has also been known to use simple narrow headed chisels to remove loose material from the cracks defined between bricks. Unfortunately there is a tendency either for the chisel to skate across the surface of the mortar or for it to be driven too deeply into the mortar.

It is known from German Patent Specification No. DE 1427719 to provide a wheeled carriage for cutting channels in a flat surface such as a wall. The carriage is supported on wheels that maintain the orientation and depth of penetration of a reciprocating chisel relative to the wall surface, the chisel being driven by a rotary hammer mounted in the carriage. The chisel tip is however covered by the carriage and therefore its progress cannot be monitored. Furthermore the carriage is a relative bulky structure as a result of the incorporation therein of a reciprocating hammer device and thus projects to a considerable height above the wall surface. These features are acceptable when cutting channels in, for example plasterwork, but are not acceptable for removing mortar from between bricks. In the latter case it is necessary for the user of the tool to be able to see the tool tip so as to be able to monitor its progress through mortar the consistency of which varies greatly from place to place in a single wall. Furthermore the bulky carriage structure and the location of the cutting tip beneath the carriage prevents the use of such a device in removing mortar from walls adjacent or behind for example rainwater downspouts or internal corners.

German Patent Specification No. DE 3312019 describes a device for removing mortar from between bricks using a rotary drill with a reciprocating hammer ation, the drill extending through a sleeve the end of which bears on the brick surface so as to limit the depth of penetration of the drill. Unfortunately the sleeve prevents visual monitoring of the progress of the drill bit, and if the drill bit hits a particularly hard region of mortar it can easily be thrown out of the crack so as to run across the adjacent brick surfaces.

U.S. Pat. No. 3,662,423 describes a tool for raking loose mortar from between bricks. This tool has two rollers spaced to run in respective adjacent mortar gaps, the intention being that the engagement of the rollers in the adjacent mortar gaps will make it less likely for the raking bit to jump free of the crack within which it is being used. The axis of the rollers are off-set and the raking bit is arranged radially relative to a cross member linking the two rollers. Thus the depth of penetration of the raking bit is closely controlled. Unfortunately, in many situations the distance between the two adjacent brick joints varies along the length of a single course of brick. Furthermore, although the described device is suitable for use as a hand held tool it would not be able to withstand the forces to which it would be exposed if mounted in a mechanised hammer device. The arrangement of the raking bit so as to extend radially with respect to the cross member extending between the rollers is such that it would be subjected to very large forces if used with a reciprocating hammer tool. Furthermore if the device where to be used to rake vertical brick joints the two rollers would engage the two adjacent horizontal brick joints at different times resulting in a very uneven action.

British Patent Specification No. GB1412214 describes a tool for smoothing out fresh mortar, the tool comprising a pair of wheels from which a blade depends. Little pressure is required of course to smooth out fresh mortar. Although the depth of penetration of the blade between the bricks is a function of the angle at which the tool handle is held, it is relatively easy to control this angle given that the tool is not subjected to large forces. It would not be practical to use such a tool to remove mortar from between bricks.

It is an object of the present invention to provide a chisel which obviates or mitigates the above problems.

According to the present invention there is provided a chisel for removing material from a crack defined between two adjacent bricks of a wall, comprising a body supporting a working tip the width of which is less than the width of the crack from which it is desired to remove material, and at least one roller mounted on the body so as to support the chisel on the wall and thereby limit the maximum depth of penetration of the tip into the said cracks, the or each roller being supported on the body so as to be rotatable about at least one axis, characterised in that the body is provided with means engagable by a reciprocating tool which in use of the chisel is located in a position behind said at least one axis and above the plane defined by the wall, and the tip is supported on the body so as to project in front of the said at least one axis and beneath the said plane.

Preferably, the chisel comprises at least two rollers rotatable about respective front and rear axes, the tip projecting beyond the front axis and the said position being behind the rear axis.

The chisel may be provided with two pairs of rollers to provide a four point support for the chisel. The roller sizes may be adjustable, or the position of the rollers on the chisel may be adjustable, to determine the chisel depth of penetration for a given orientation of the chisel.

The chisel tip may be removable to enable tips of various widths to be mounted on the chisel body, and to enable the replacement of worn tips. Generally however the chisel tip will be permanently secured to the chisel body.

As is common with various tool assemblies, it is desirable in the case of the fixed-tip chisel described above to provide a quick release mechanism so that a chisel of one tip width can be rapidly replaced in a reciprocating tool by a chisel of a different width. This can be necessary where the width of a crack from which mortar is being removed varies along its length.

Various quick release tool assemblies are known. For example, so-called "snap-on" tools are known which comprise a tool drive shaft having a square end which is a snap fit in a square-section socket of the tool head. There are also many quick release chuck assemblies where for example a tool can be released by pulling a retaining collar along the body of the chuck. There are circumstances however in which the known quick release tool assemblies are inadequate either because they are too bulky or because they require two-handed operation. For example, in the case of the chisel described above, the spacing between adjacent bricks from between which mortar is to be removed, and hence the maximum chisel width, can vary considerably from one part of a wall to another, and yet it is important for the chisel head to be as wide as possible if effective mortar removal is to be achieved. This means that it is often necessary to repeatedly switch between say three or more standard chisel tipsizes as one progresses along a single course of bricks. In such circumstances it is necessary to be able to hold the reciprocating tool in one hand while switching the chisel tip or the entire chisel with the other. This can be achieved satisfactorily if the chisel is a simple sliding fit in a bore of the reciprocating tool, the chisel being retained against accidental release from the tool by a simple spring-loaded latch. Unfortunately if, as is often the case, the chisel becomes jammed between adjacent bricks, it cannot be removed by simply pulling on the reciprocating tool body as such an action would simply disengage the reciprocating tool from the chisel and leave the chisel embedded in the wall.

It is a further object of the present invention to provide an improved quick release tool assembly which can obviate or mitigate the above problems.

According to a second aspect of the present invention, there is provided a quick release tool assembly comprising a tool holder which in use is driven by a power source, and a tool shaft which is in use received in the tool holder, wherein a groove is defined in the outer surface of the shaft, the groove comprising a first portion extending substantially axially from one end of the shaft, a second portion spaced from the said one end of the shaft and extending substantially circumferentially from the first portion, and a third portion extending substantially axially from the second portion and away from the said one end of the shaft, wherein the tool holder defines a tool shaft receiving bore into which a retaining pin projects radially to engage in said groove, the pin preventing movement of the shaft within the bore except in a direction which enables the pin to slide along the groove.

Preferably retaining means are provided to prevent movement of the shaft relative to the bore unless a predetermined minimum force is applied to the shaft.

When the shaft is inserted into the bore, it is positioned so that the pin can slide along the first portion of the groove, rotated about its axis so that the pin slides along the second portion of the groove, and then pushed home axially so that the pin slides along the third portion of the groove. If an attempt is then made to pull the shaft straight out the pin slides along the third portion of the groove but jams against the side wall of the second portion of the groove where it meets the third portion of the groove. Removal of the shaft requires rotation of the shaft about its axis. The retaining means ensures that the shaft cannot fall from the tool under its own weight as the result of for example random vibrations causing the shaft to rotate within the bore.

The bore may be of circular cross-section, the retaining pin extending radially towards the bore axis. The retaining means may be a spring-loaded member which presses against a flat formed on the tool shaft to hold the shaft in friction engagement with the wall of the bore. The pin and spring-loaded member may be located on diametrically opposed sides of the bore, with the third portion of the groove in the flat being on diametrically opposed sides of the shaft. Alternatively the retaining means may be associated with the retaining pin, for example by arranging for the pin to be spring-loaded.

Embodiments of the present invention will now be described, by way of example, with reference to the accompanying drawings, in which:

FIG. 1 is a side view of a chisel in accordance with the invention;

FIGS. 2 and 3 are views on the lines 2—2 and 3—3 of FIG. 1;

Figure 6:
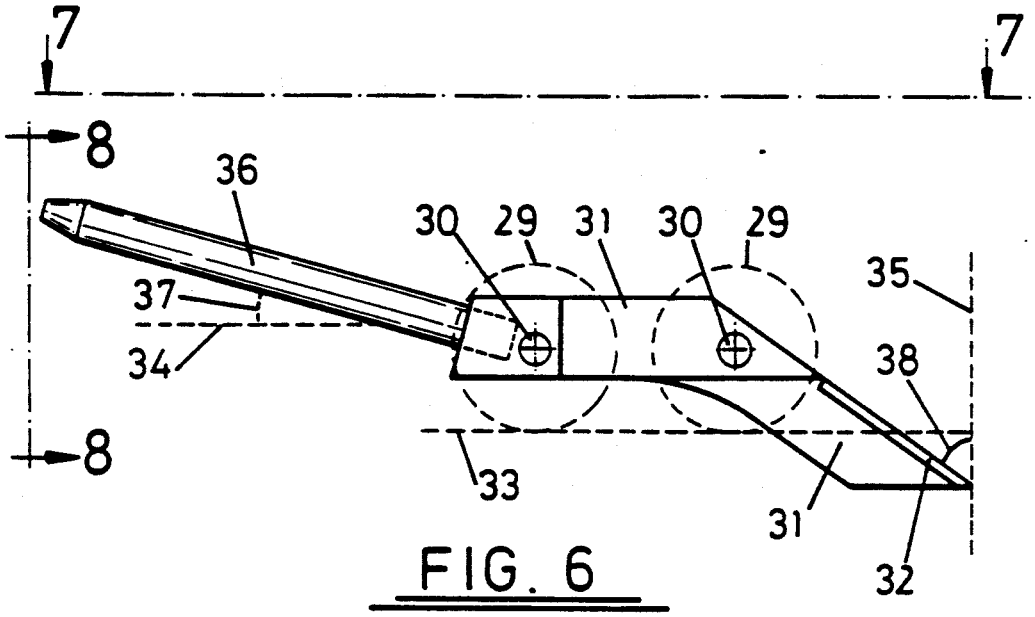
FIG. 6 is a side view of the body and tip of a further embodiment of the invention.
Figure 7:
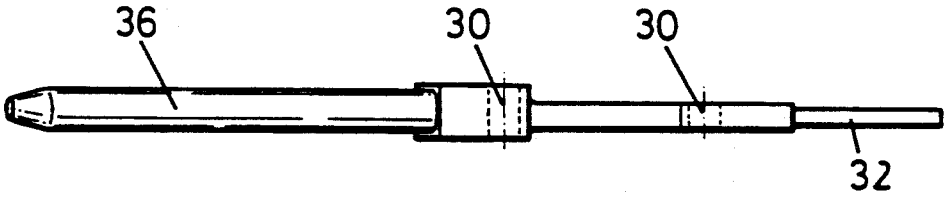
Figure 8:
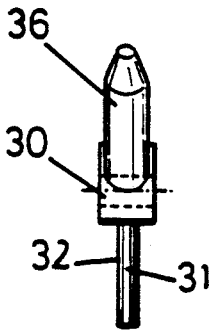
Figure 10:
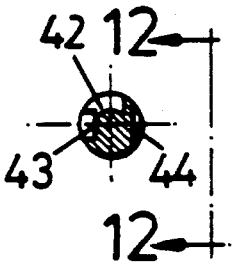
Figure 9:
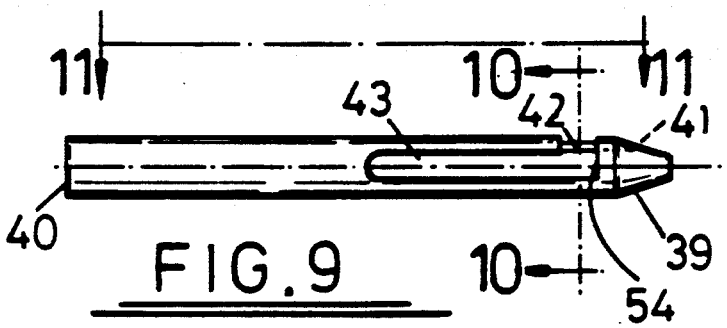
Figure 11:
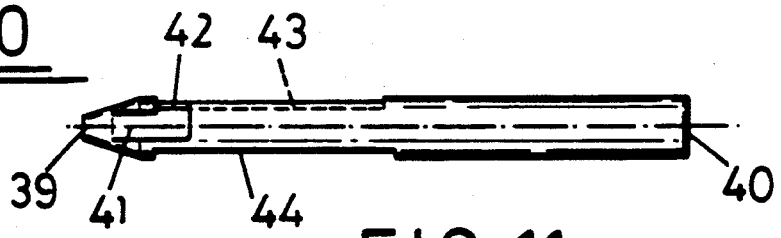
Figure 13:
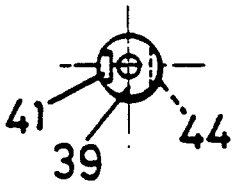
Figure 12:
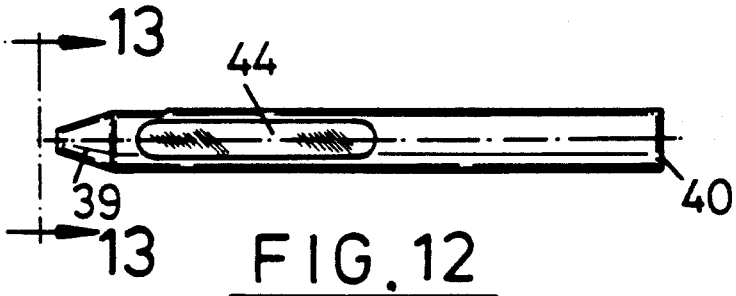
Figure 14:
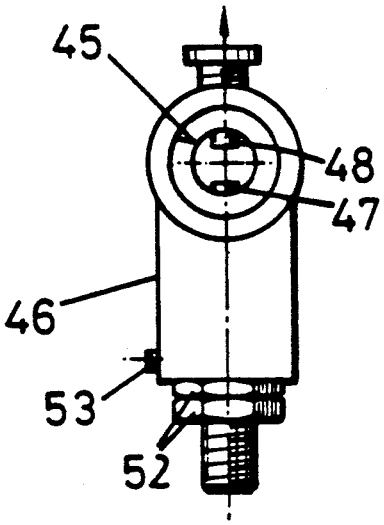
Figure 15:
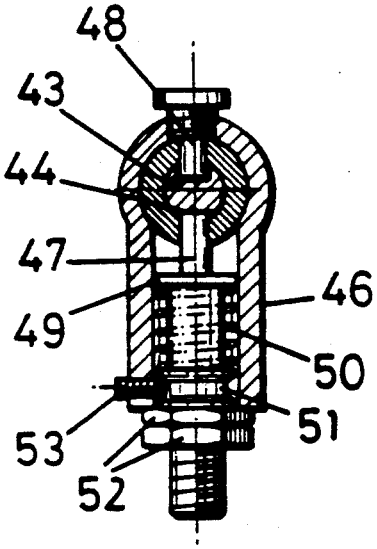

FIGS. 7 and 8 are respectively views in the lines 7—7 and 8—8 of FIG. 6;

FIG. 9 is a side view of a tool shaft for use in a quick release mechanism to enable rapid replacement of one chisel by another;

FIGS. 10 and 11 are views in the lines 10—10 and 11—11 respectively of FIG. 9;

FIG. 12 is a view on the lines 12—12 of FIG. 10;

FIG. 13 is a view on the lines 13—13 of FIG. 12;

FIG. 14 is an end view of a tool holder adapted to receive the shaft illustrated in FIGS. 9 to 13; and FIG. 15 is a sectional view through the tool holder of FIG. 14 after insertion of the shaft illustrated in FIGS. 9 to 13.

Figure 1:
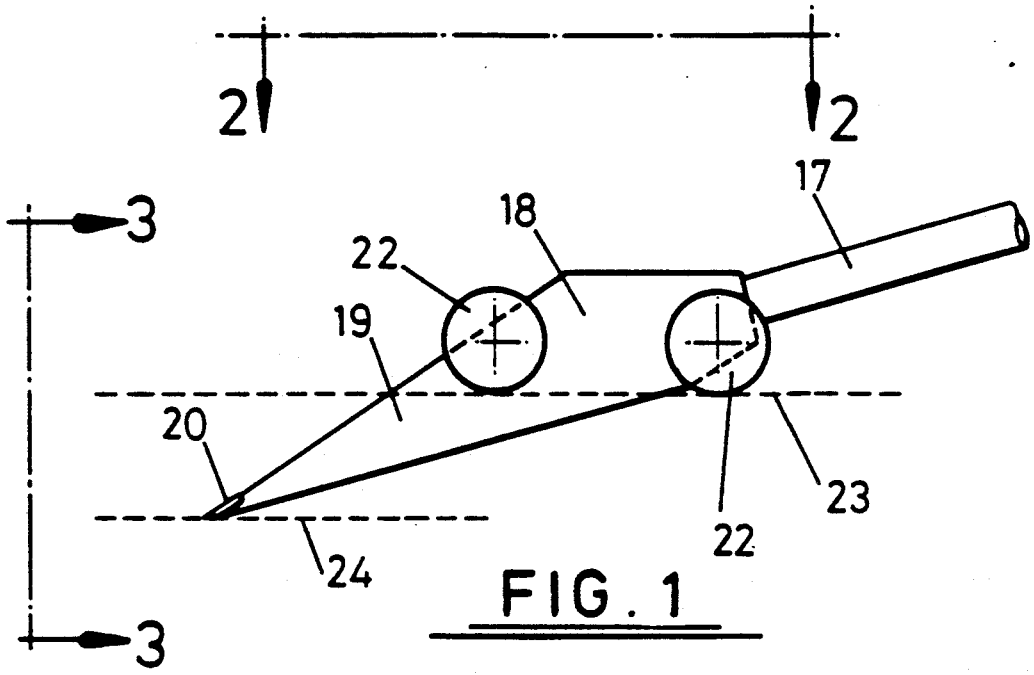
Figure 2:
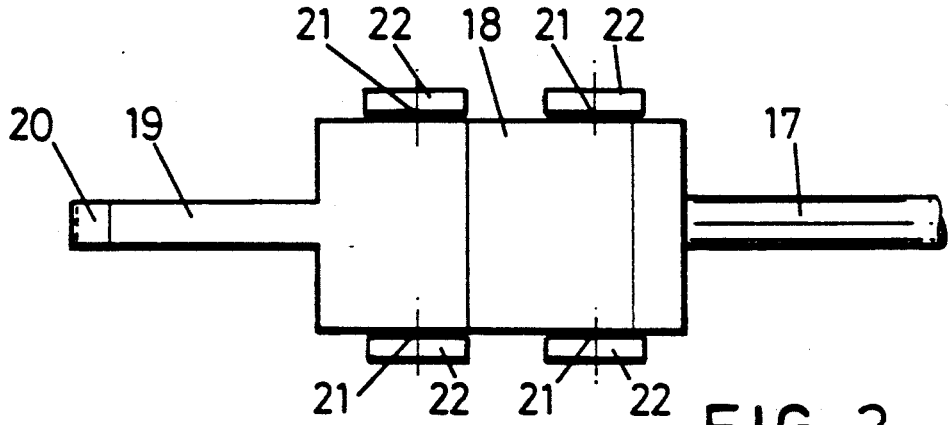
Figure 3:
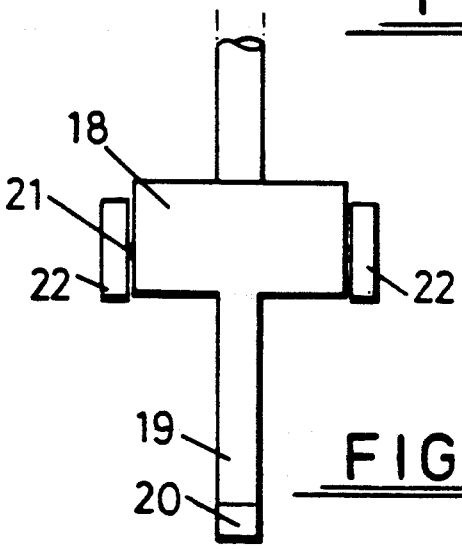

Referring to FIGS. 1, 2 and 3 an embodiment of the invention is illustrated which comprises a shaft 17 for engagement in a conventional power tool. The shaft 17 is secured to a body 18 from beneath which projects a blade 19. The tip of the blade 19 supports a tungsten cutting edge 20.

Four pins 21 project from the sides of the body 18 and support respective rollers 22. When the chisel is placed on a brick surface as indicated by broken line 23 in FIG. 1 the underside of the body 18 is supported clear of that surface on the four wheels and the blade 19 extends beneath the surface 23 to a predetermined depth indicated by broken line 24. It would of course be possible to tip the chisel up so that it ran on either only the front pair of rollers or the back pair of rollers so as to adjust the penetration depth but ideally the chisel will be used with all four rollers 22 in contact with the brick surface as this determines the penetration depth.

The rollers 22 may be fabricated from any suitable material, for example nylon or silicon rubber. Although the rollers are shown as being relatively narrow they could of course be of whatever width is required. For example the body 18 could be of the same width as the blade 19 and the width of the rollers 22 could be extended appropriately.

The rollers 22 may be a simple snap-fit on the pins 21 so as to make it possible to rapidly and easily replace rollers which become worn or otherwise damaged.

The embodiment of FIGS. 1 to 3 incorporates four rollers. It will however be appreciated that only two rollers could be provided if it was not desired to have a clear indication of the penetration depth as is provided where two pairs of rollers are supported on the body 18. It would also be possible if desired to have a single roller, preferably supported in line with the blade 19. A single roller could be accommodated in an aperture in the body 18, the aperture being in line with the blade 19.

Figure 4:
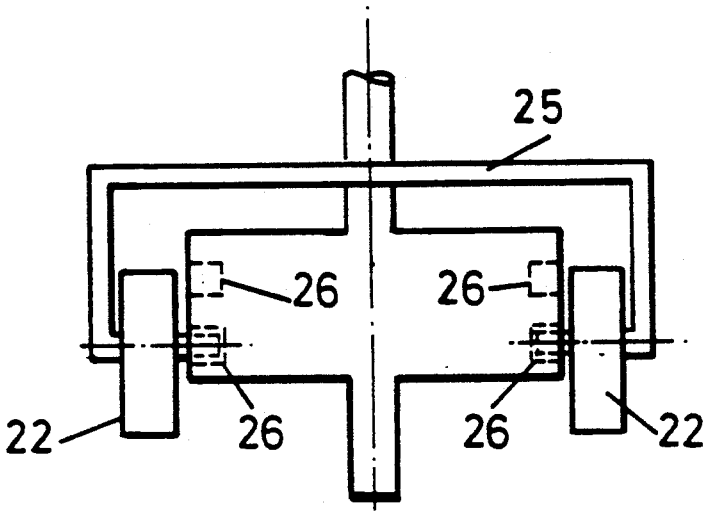
FIG. 4 is a view of a still further embodiment of the invention.
Figure 5:
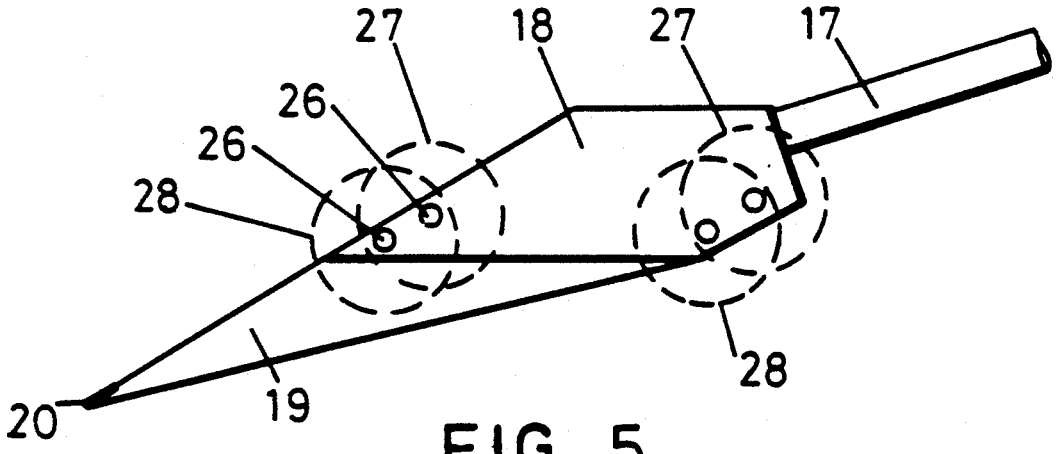
FIG. 5 is a view of the chisel of FIG. 4 after removal of support rollers.

A further embodiment of the invention is illustrated in FIGS. 4 and 5. This embodiment is similar to that of FIGS. 1 to 3 and accordingly the same reference numerals are used where appropriate. In the embodiment of FIGS. 4 and 5 however rollers 22 are supported on a spring clip 25 the ends of which can be inserted into alternative blind holes 26. As best shown in FIG. 5, two pairs of holes 26 are provided on each side of the body 18 when the ends of the spring clip 25 are supported in the uppermost holes 26 (as viewed in FIG. 5). The rollers 22 assume the position shown by broken lines 27. If the ends of the spring clip 25 are inserted in the lower holes 26 the rollers 22 assume the position shown by the broken lines 28. Thus by appropriate positioning of the spring clip 25 the chisel can be arranged so that with all four wheels in contact with the brick surface the under surface of the body 18 assumes one of two spacings from the brick surface or is either tipped up to reduce the depth of penetration whilst swinging the shaft 17 down towards the brick surface or is tipped down to increase the depth of penetration whilst swinging the shaft 17 away from the brick surface.

It will be appreciated that a variety of chisels could be provided having a variety of tip and shoulder widths to enable material to be efficiently removed from gaps of a variety of widths.

Referring now to FIGS. 6 to 8, this illustrates details of the shape of a further chisel body intended to support four wheels 29 shown in outline only on axles (not shown) which are an interference fit in holes 30 defined by the body. The wheels are secured on the pins by resilient split pins (not shown) so that wheels can be exchanged simply by pulling out the pins, pulling the wheels off the axles, pushing on fresh wheels, and reinserting the pins.

The holes 30 are defined in a central portion of the body from which projects a tip 31 supporting a tungsten cutting tip 32. The tip 32 is wider than the tip 31 and thus the tip 31 can move easily through a slot cut by the tip 32.

The dotted line 33 represents the surface of a wall between the bricks of which tips 31 and 32 have been driven. The dotted lines 34 and 35 are respectively parallel to and perpendicular to line 33. A shaft 36 is provided for insertion in a reciprocatory tool intended to reciprocate the shaft parallel to the shaft axis. The shaft 36 defines an angle 37 with the dotted line 34, and the tip 32 defines an angle 38 with the dotted line 35. Tests have shown that the angle 37 should be in the range of 10 to 45, preferably 20, and that the angle 38 should be in the range of 35 to 75, preferably 55.

The double rollers could be interconnected by a pair of endless belts in the manner of the track of a tracked vehicle.

The depth of penetration of the chisel tip can be adjusted by changing the diameters of all of the wheels, or by changing the diameters of one pair only of the wheels. In the latter case however, the angles 37 and 38 could also be adjusted and care would therefore have to be taken to ensure that these angles were maintained within acceptable limits. For example, if the angle 38 became too small and the angle 37 became too large, there would be a tendency for the chisel tip to become embedded in the mortar to be removed.

Various chisel tip shapes can be used, for example a simple square-ended "spade" as shown in the drawings, or tips of triangular, curved, serrated etc. shape.

Referring now to FIGS. 9 to 13, there is illustrated a tool shaft suitable for use as the shaft of one of the above-described chisels or any other tool requiring a quick-release engagement with a tool holder. The shaft has a tapered free end 39 and a tool head end 40 which is simply shown as a flat circular surface. In the case of a chisel as described above, the end 40 would be inserted in the chisel body. A groove is formed on the outer surface of the shaft, the groove comprising a first portion 41 leading axially from the tapered end 39 of the shaft, a circumferential second portion 42 connecting with the end of the groove portion 41 remote from the end of the shaft, and an axially extending third portion 43 which extends from the second portion 42. A flat 44 is also formed on the outside of the shaft, the flat 44 being positioned diametrically opposite the third portion 43 of the groove.

Referring now to FIGS. 14 and 15, details of a tool holder bore adapted to receive the shaft illustrated in FIGS. 9 to 13 are shown. The tool holder comprises a cast body defining a circular bore 45 and a tubular side member 46 which communicates with the bore 45. The side member 46 has a spring-loaded latch member 47 and a retaining pin 48 is fixedly secured so as to project radially into the bore 45 opposite the latch member 47. It will be seen from FIG. 15 that the retaining pin 48 is received in the third portion of the groove 43 when the tool is inserted into the holder and the latch member 47 bears against the flat 44.

The latch member comprises a cylindrical body supporting a fixed flange 49 against which a compression spring 50 bears. The other end of the spring bears against an annular collar 51 which is slidable on the latch member 47. The end of the latch member 47 remote from the bore 45 is threaded and supports two lock nuts 52 the adjustment of which determines the distance to which the latch member 47 projects into the bore. The collar 51 is retained in the tubular member 46 by a grub screw 53.

When the tool shaft is inserted the latch member 47 rides up the tapered end 39 of the tool shaft. The tool shaft is then rotated and pushed home and the latch member 47 drops down onto the flat 44. Removal of the tool shaft requires a reversal of these steps. It will be appreciated that axial movement of the latch member 47 as the tool is inserted and removed results in a gap appearing between the collar 51 and the lock nuts 52. The latch member 47 is effective to prevent the tool shaft sliding and vibrating free accidentally. Any attempt to simply pull the tool shaft straight out of the tool holder results in the retaining pin 48 jamming against the end of the third portion 43 of the groove adjacent the shaft end 39.

It will be appreciated that the function of the latch member may be achieved with a less complicated structure than that shown in FIGS. 14 and 15. For example a simple spring-loaded bore could be used. Alternatively the retaining pin 48 could itself be spring-loaded. As a further alternative, the spring latch member 47 could be dispensed with entirely so that the tool shaft is free to slid axially within the holder. In such an arrangement it would be desirable to shape the end of the groove 43 adjacent the shaft tip 39 so as to prevent the retaining pin sliding accidentally along the groove edge 54 (FIG. 9). The edge 54 could define for example a semi circular recess aligned with the groove 43, or the groove 42 could be displaced along the shaft away from the tip 39 so that the groove 43 extends beyond the groove 42 towards the tip 39. In both cases a retaining pin receiving recess is defined at the end of groove 43.

I claim:

1. A chisel for removing material from a gap defined between two adjacent surfaces, comprising:

a central body portion, a shaft and a working tip extending from opposite ends of the central body portion, the shaft having a free end and being connected to the working tip such that the working tip may be driven into a surface against which it bears by striking the free end of the shaft, at least one roller supported by the central body portion, the roller being rotatable about an axis perpendicular to a line defined by the free end of the shaft and the working tip, the roller having a circumference and the working tip having a length such that the working tip projects beyond the circumference of the roller on the side of the roller remote from the shaft, the roller being disposed such that the chisel can be supported by the roller on the two adjacent surfaces with the working tip extending into the gap, wherein the at least one roller comprises:

a first roller supported by the central body portion and rotatable about a front axis, a second roller supported by the central body portion and rotatable about a rear axis, the front and rear axes being parallel, the tip projecting from adjacent the front axis to a point on the side of the front axis remote from the shaft, the shaft projecting from adjacent the rear axis to a point on the side of the rear axis remote from the tip, and the rollers being arranged such that the tip projects into the gap through a plane defined by the two adjacent surfaces when the first and second rollers are placed in contact with the two adjacent surfaces.

2. A chisel according to claim 1, comprising a first pair of rollers supported by the central body portion and rotatable about the front axis, and a second pair of rollers supported by the central body portion and rotatable about the rear axis.

3. A chisel according to claim 2, wherein the rollers have substantially equal outside diameters.

4. A chisel according to claim 1, comprising two apertures, wherein at least one of the rollers is supported on an axle which is detachable from the central body portion, and the roller may be positioned with the axle in any one of the two apertures.

5. A chisel according to claim 1, wherein the shaft extends in a direction which subtends an angle of from approximately 10 degrees to approximately 45 degrees with the plane defined by the two adjacent surfaces.

6. A chisel according to claim 1, wherein the chisel tip subtends an angle with a line perpendicular to the plane defined by the two adjacent surfaces of from approximately 35 degrees to approximately 75 degrees.

7. A chisel for removing material from a gap defined between two adjacent surfaces, comprising a central body portion, a shaft and a working tip extending from opposite ends of the central body portion, the shaft having a free end and being connected to the working tip such that the working tip may be driven into a surface against which it bears by striking the free end of the shaft.

at least one roller supported by the central body portion, the roller being rotatable about an axis perpendicular to a line defined by the free end of the shaft and the working tip, the roller having a circumference and the working tip having a length such that the working tip projects beyond the circumference of the roller on the side of the roller remote from the shaft, the roller being disposed such that the chisel can be supported by the roller on the two adjacent surfaces with the working tip extending into the gap, a tool holder for receiving the shaft, the shaft having an outer surface defining a groove, the groove comprising:

a first portion extending substantially axially from one end of the shaft, a second portion spaced from the one end of the shaft and extending substantially circumferentially from the first portion, and a third portion extending substantially axially from the second portion and away from the one end of the shaft, and the tool holder defining a shaft receiving bore into which a retaining pin projects radially to engage in the groove, the pin preventing movement of the shaft within the bore except in a direction which enables the pin to slide along the groove.

8. A chisel according to claim 7, comprising:

retaining means for preventing movement of the shaft relative to the bore unless a predetermined minimum force is applied to the shaft.

9. A chisel according to claim 8, wherein the bore defines a circular cross section and wherein the retaining pin extends radially towards the bore axis.

10. A chisel according to claim 8, wherein the retaining means comprises a spring-loaded member for pressing against a flat formed on the shaft to hold the shaft in friction engagement with the wall of the bore.

11. A chisel according to claim 10, wherein the pin and spring-loaded member are located on diametrically opposed sides of the bore, with the third portion of the groove and the flat being on diametrically opposed sides of the shaft 17.

12. A chisel for removing material from a gap defined between two adjacent surfaces, the chisel comprising:

a) a central body portion b) a first roller mounted adjacent a first end of the central body portion and rotatable about a first axis, c) a second roller mounted adjacent a second end of the central body portion and rotatable about a second axis, d) a working tip extending from the first end of the central body portion, the working tip having a width less than the width of the gap, and e) a shaft extending from the second end of the central body portion to a free end of the shaft, wherein the first and second axes are parallel and define a first plane, the radially outer edges of the rollers define a second plane parallel to the axes, the working tip is located on one side of the second plane and the roller axes are located on the opposite side of the second plane to the one side, the free end of the shaft is located on the opposite side of the second plane, and a longitudinal axis of the shaft and a cutting edge of the working tip are intersected by third plane perpendicular to the roller axes.

* * * * *